United States Patent [19]

Mabb

[11] Patent Number: 4,514,994

[45] Date of Patent: May 7, 1985

[54] APPARATUS FOR AERATING LIQUIDS

[75] Inventor: Kenneth G. Mabb, Peterborough, England

[73] Assignee: Sodastream Limited, Peterborough, England

[21] Appl. No.: 433,209

[22] PCT Filed: Apr. 21, 1982

[86] PCT No.: PCT/GB82/00116

§ 371 Date: Sep. 27, 1982

§ 102(e) Date: Sep. 27, 1982

[87] PCT Pub. No.: WO82/03751

PCT Pub. Date: Nov. 11, 1982

[30] Foreign Application Priority Data

Apr. 27, 1981 [GB] United Kingdom ..... 8112942

[51] Int. Cl.[3] ..... B67D 5/62

[52] U.S. Cl. ..... 62/389; 222/399

[58] Field of Search ..... 62/389, 390, 98, 394; 222/399

[56] References Cited

FOREIGN PATENT DOCUMENTS 249306 4/1926 United Kingdom .

1405245 9/1975 United Kingdom .

*Primary Examiner*—Henry Bennett

*Attorney, Agent, or Firm*—Watson, Cole, Grindle & Watson

[57] ABSTRACT

An apparatus for carbonating liquids is mounted on the inside of the door (1) of a domestic refrigerator, and a control lever (76) on the outside of the door is operable to control (i) the supply of water from a reservoir tank (7) to the carbonating chamber (8), (ii) the supply of gas from a cylinder (37) to the carbonating chamber for injection into the water, (iii) the operation of an exhaust valve (41) to release the gas pressure in the carbonating chamber (8), and the discharge of carbonated water from the chamber (8) to a nozzle (21) on the outside of the refrigerator door. Water flows into and out of the chamber through a single port (11) in the base of the chamber which houses a spool valve (16) reciprocable in opposite directions to connect the port (11) to the reservoir tank (7) and to the discharge nozzle (21).

20 Claims, 5 Drawing Figures

APPARATUS FOR AERATING LIQUIDS

This invention relates to apparatus for aerating liquids, and in particular for carbonating water.

Known types of aerating apparatus include industrial plants for large scale production of bottled beverages comprising carbonated water; smaller plants of a commercial size for use in making carbonated drinks at the location of sale to the public, e.g. a bar or restaurant; and portable machines for domestic household use. The last mentioned devices are simple and compact compared with the industrial and commercial carbonating plants, and have become popular in recent years.

It is well known that the carbonation of water is improved if the water is chilled prior to introducing the carbon dioxide gas. For this reason it is usual to include in the known industrial and commercial plants a cooler for cooling the water before carbonation. In the case of the known portable machines intended for domestic use, however, incorporating a cooling mechanism for cooling the water is not considered a practical proposition since it would complicate the device, substantially increase its cost and make it less compact. Consequently, it is suggested that bottles of water be chilled in a refrigerator before being carbonated using the portable machines, but this is often inconvenient. As a solution to this drawback, it has been proposed to provide the portable apparatus with a detachable reservoir tank from which the water is drawn into a pressure chamber for carbonation. The idea is that a spare tank of water should be kept within the refrigerator so that it is well cooled when mounted on the apparatus. The result is satisfactory only if the entire contents of the reservoir are carbonated upon being removed from the refrigerator, otherwise the uncarbonated water soon returns to ambient temperature. There is also a disadvantage in the need to replace continually the reservoir tank and remember to store the spare tank in the refrigerator.

In U.S. Pat. No. 2,103,479 it has been proposed to provide a carbonator housed entirely within the food compartment of a refrigerator. The carbonator is connected to the water supply system, which is inconvenient since it means that the refrigerator must be plumbed in to the household water supply. The apparatus is also inconvenient to use since the refrigerator door must be opened to gain access to the controls and the discharge nozzle of the carbonator. Furthermore it enables only a relatively small volume of water to be cooled ready for carbonation so it is not capable of producing several chilled carbonated drinks in quick succession. An additional disadvantage is that the carbonated water is discharged under pressure which can cause foaming and splashing within the refrigerator.

The present invention aims at providing a solution to the above drawbacks and in accordance with a first broad aspect resides in a domestic refrigerator having a cold food compartment defined within a walled cabinet including a door, and a carbonating apparatus mounted within the cold chamber and operable to deliver carbonated liquid to a discharge nozzle, characterised in that said carbonating apparatus is mounted on the inside of the refrigerator door and comprises a sealed pressure chamber and a reservoir both exposed to the temperature in the cold compartment, valve means to control supply of liquid to the pressure chamber from the reservoir tank and discharge of liquid from the pressure chamber to the nozzle, a gas supply valve for controlling supply of pressurised gas from a gas source to the pressure chamber, an exhaust valve operable to release the gas pressure in the pressure chamber, and a control arrangement for operating the liquid flow control valve means, said gas supply valve and said exhaust valve, said control arrangement extending through the refrigerator door to be operable from outside the cold compartment, and said discharge nozzle being mounted to deliver liquid on the outer side of the door.

The carbonating mechanism may be controlled by means of a member carried by a control shaft which extends through the door of the refrigerator cabinet. The shaft is preferably of thermally insulating material and sealed to the door to avoid any heat conducting paths through the door which might create hot spots within the food storage compartment.

In order that the efficiency of the refrigerator should not be impaired it is necessary for the full insulation thickness of the door to be retained. The carbonating apparatus disclosed herein is of compact design enabling it to be mounted on a refrigerator door without taking up a substantial part of the food storage space. Nevertheless it permits several cooled drinks to be dispensed. It is also self contained and does not require connection to either electricity or water main.

In accordance with a second aspect the invention provides a novel apparatus for carbonating liquids comprising a sealed pressure chamber, valve means for controlling supply of liquid to the pressure chamber and discharge of liquid from the pressure chamber, and a gas supply valve for controlling supply of pressurised gas from a gas source to the pressure chamber, characterised by a base member defining a bottom wall of the pressure chamber and a valve housing of the liquid control valve means, a single port in the bottom wall for flow of liquid into and out of the chamber, and a valve member received in the valve housing and adjustable in opposite directions from a centre position closing the port for bringing the port into communication with a liquid supply and an outlet nozzle, respectively.

The use of a common valve mounted in the base member of the pressure chamber for controlling the liquid flow into and out of the pressure chamber has the advantages of making the apparatus compact as well as simple both in construction and operation. The correct sequence of valve actuations can also be performed easily by a single control member. These advantages combine to make the apparatus especially suitable for use in a domestic carbonating machine or for mounting within the door of a refrigerator or in a water cooling unit.

A better understanding of the invention will be had from the following detailed description which is given with reference to the accompanying drawings, in which.

Figure 4:
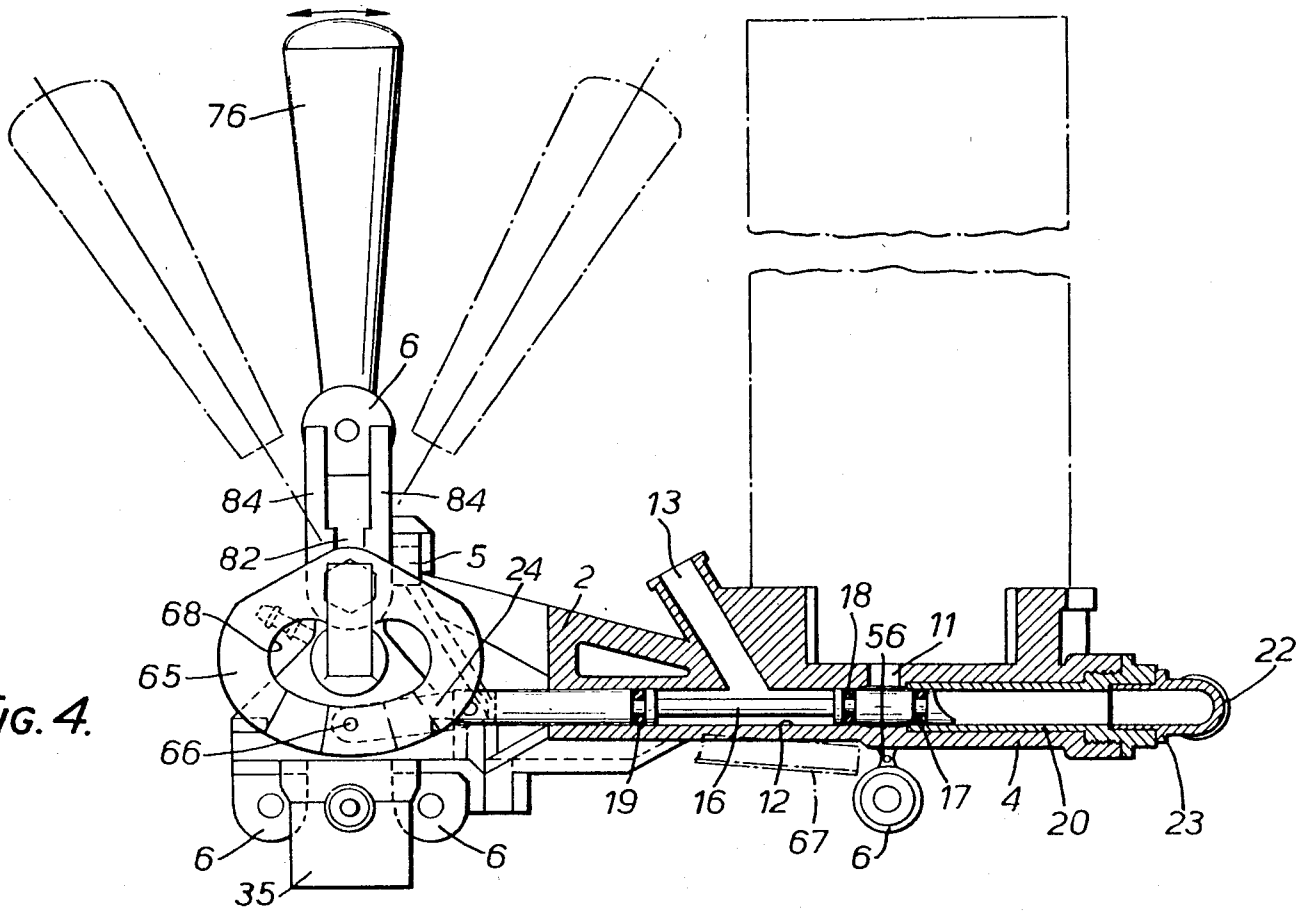
FIG. 4 is a detail view with the valve system of the carbonation chamber illustrated in axial cross-section.
Figure 5:
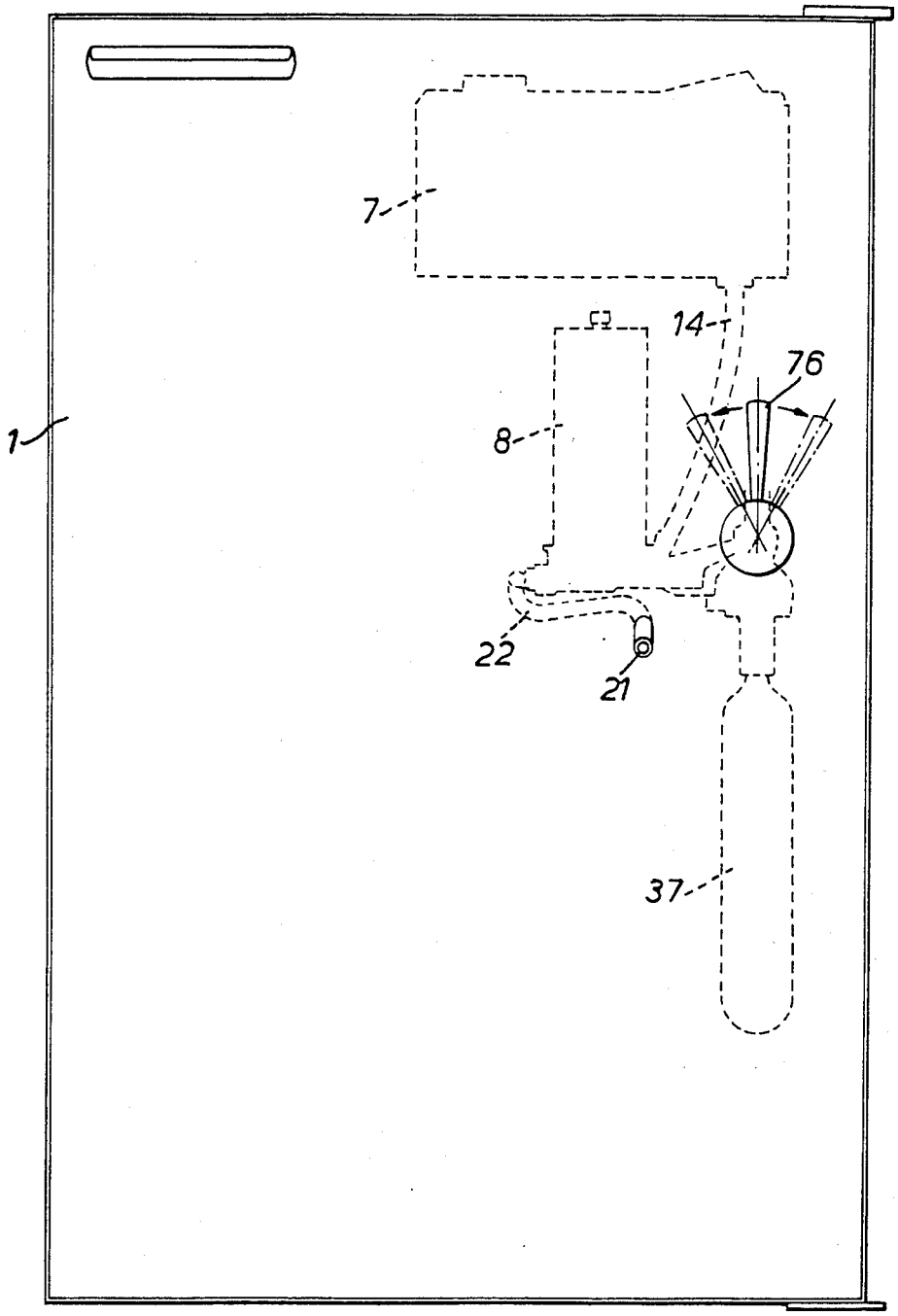
FIG. 5 is a front view of the refrigerator.

In the drawings reference numeral 1 designates the door of a domestic refrigerator which in accordance with conventional practice incorporates a layer of thermal insulation to minimise heat transfer through the door. On the inside of the door is mounted a liquid carbonating apparatus having a rigid chassis frame assembled from two separately moulded sections 2, 3 which are firmly interlocked by snap-fit connections 5. The chassis frame is secured firmly to the door by screws inserted at four mounting points 6 provided on the chassis. The first chassis section 2 incorporates a base member 4 forming the bottom wall of the carbonating chamber and defining a valve housing for a valve which controls flow of liquid into and out of the chamber. The carbonating chamber is provided by a metal, e.g. aluminium, cylinder 8 which has its lower end screwed into a threaded recess in the base member 4, and is fitted with a moulded screw cap 9 at its upper end. A seal 10 is fitted between the bottom edge of the cylinder and the bottom wall of the recess, and a port 11 in the latter communicates the interior of the carbonating chamber with a through bore 12 in the base member 4. A side inlet port 13 also communicates with the bore 12 and is connected by a tube 14 to a tank coupling member 15 adapted for releasable connection to the outlet of a reservoir tank 7 mounted on the inside of the refrigerator door 1 above the carbonating chamber. Slidable in the bore 12 is a valve spool 16 having a solid part between two seals 17, 18 positionable to close the port 11 (as seen in FIG. 4), and a recessed portion between seals 18 and 19 capable of bringing ports 11 and 13 into communication on displacement of the spool 16 to the right from the position shown in FIG. 4. A sleeve member 20 is fitted into the bore 12 and defines an outlet passage with which the port 11 becomes connected on displacement of the spool 16 to the left. The end of the spool 16 is shaped with a curved face to assist flow of liquid from the carbonating chamber to the outlet with a view to reducing turbulence and minimising dissolution of gas. The outlet passage is connected to a discharge nozzle 21 located on the outside of the refrigerator door 1 through a tube 22 fitted to the sleeve 20 by a union 23. The end of the spool 16 remote from the outlet is coupled to a control mechanism, described in detail below, by a pivotal link 24.

The top cap 9 of the carbonating chamber has three ports 25–27. The first is a gas inlet and leads to a gas injection tube 28 which extends downwardly from the cap and terminates in a jet nozzle 29 located at a small distance above the chamber bottom. The second port 26 is an air vent which is controlled by a float valve comprising a valve body in the form of a plastic ball 30 held captive within a cage 31 integral with the valve seat 32 against which the ball is lifted when the chamber is filled with water. It should be noted that the seat 32 is located below the top of the chamber so that a pocket of air becomes trapped in the chamber above the water level when the float valve closes. The third port 27 in cap 9 is a gas exhaust. The gas inlet port 25 is connected by a tube 34 to a connector 35 firmly mounted on the second chassis section 3 by snap-fit connections and including a threaded socket 36 for connection of a gas cylinder 37 fitted with a valve 38. A pin 39 slidable in a bore in the connector 35 can be depressed to open the valve 38 to allow gas to escape from the cylinder 37 and pass to the injection nozzle 29.

The gas exhaust port 27 is connected by a tube 40 to a nipple 43 leading to a bore communicating with the inlet of a pressure relief valve 41 mounted on the second chassis section 3, and a pin 42 is slidable in the bore and can be pushed inwardly against the force of the valve spring to open the valve 41. The outlet side of valve 41 and the air vent port 26 are connected by tubes 44, 45 to the air space above the water level in the tank 7. Connecting them to atmosphere in this way ensures that any moisture passing out through the ports 26, 27 will be conducted to the tank 7 instead of being released into the interior of the refrigerator. In addition, should the float valve 30–32 fail to close the contents of the tank will not flood out into the inside of the refrigerator cabinet. The tube 45 from the air vent 26 preferably discharges into the top of the tank through a whistle 48, or similar sound producing device, which will produce an audible warning signal if pressurised gas is supplied to the chamber when it contains insufficient water to close the float valve.

The tank 7 is releasably mounted on the refrigerator door so that it can be removed for refilling. Its bottom wall includes an outlet socket 49 adapted to receive the coupling member 15. An inverted cup-shaped filter 50 covers the outlet on the inside of the tank and retains a ball valve member 51 arranged to close the outlet. A projection on the end of coupling member 15 normally holds the ball clear of its seat, but when the member 15 is disconnected the ball closes the outlet to prevent any water remaining in the tank from running out.

The operating or control mechanism inclues a shaft 60 journalled in a sleeve portion 61 of the second chassis section 3, and guided through the refrigerator door 1 by a sleeve seal 62 fitted within a bushing 63. Fast with the inner end of the shaft 60 and held in place by a nut 64 is quadrant arm member 65 which is connected to the link 24 of the liquid valve spool 16 by a pivot 66. A coil spring 67 is connected between this pivot 66 and an anchorage point 56 on the first chassis section 2 below the valve housing to bias the control shaft 60 and valve spool 16 to a position in which the port 11 is in communication with the reservoir tank 7. The quadrant arm 65 is provided with an aperture 68 through which the relief valve 41 projects, the aperture being of such size and shape that the valve 41 does not interfere with normal movement of member 65 to control the valve spool 16.

Figure 1:
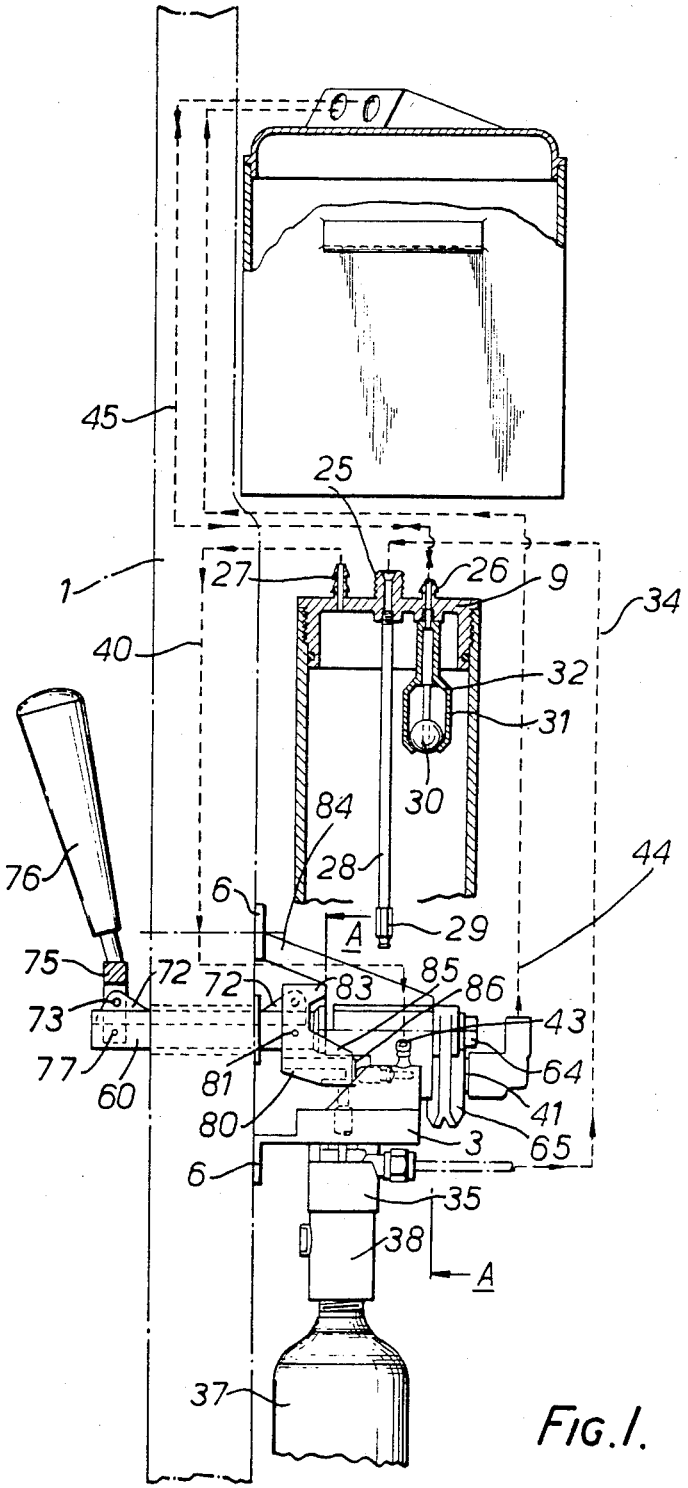
FIG. 1 is a side view showing a carbonating mechanism mounted on the inside of the door of a domestic refrigerator, the upper parts of the carbonation chamber and reservoir tank being shown in section.
Figure 2:
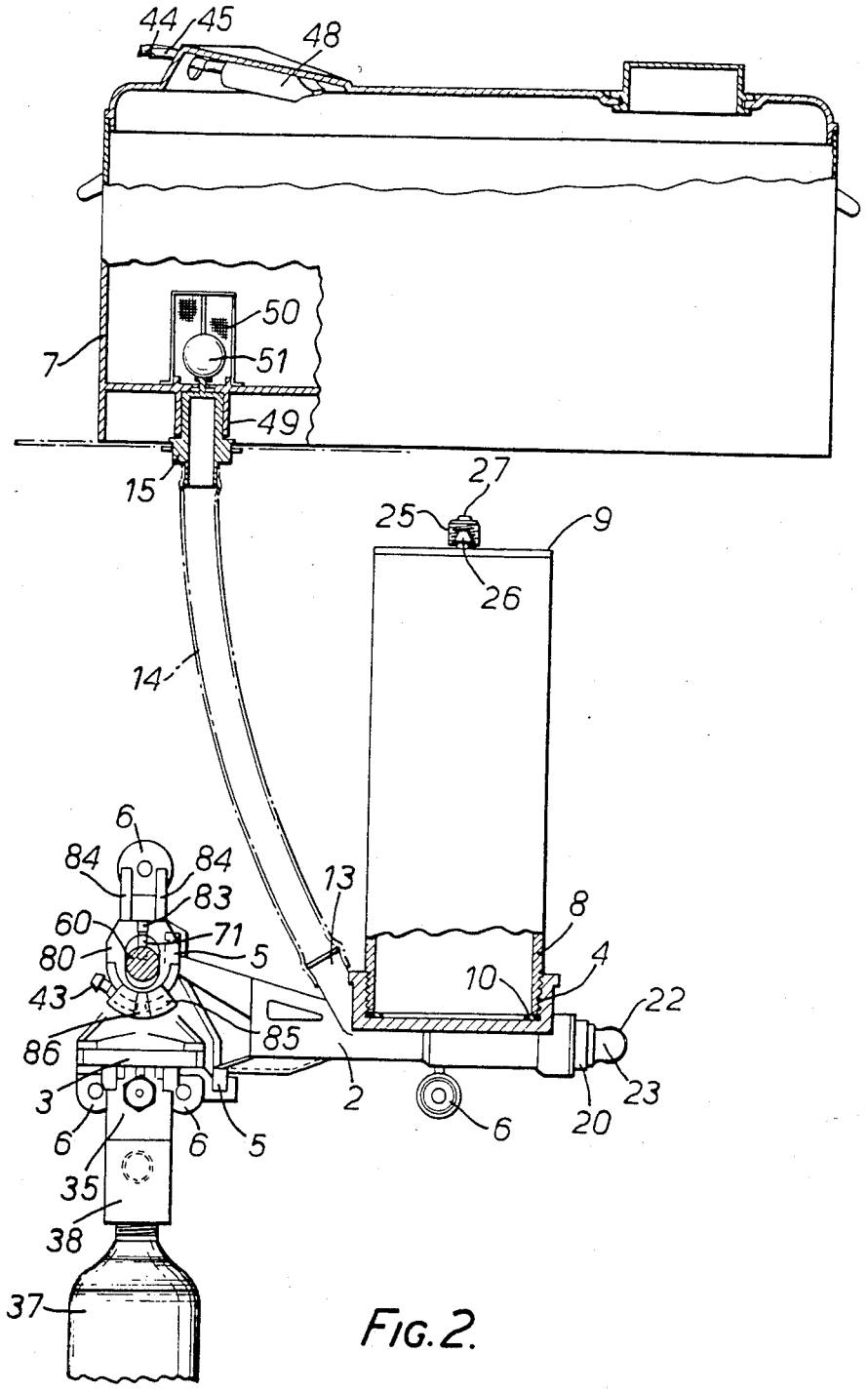
FIG. 2 is a rear view of the carbonating mechanism, partly shown in section taken along the line A—A in FIG. 1.
Figure 3:
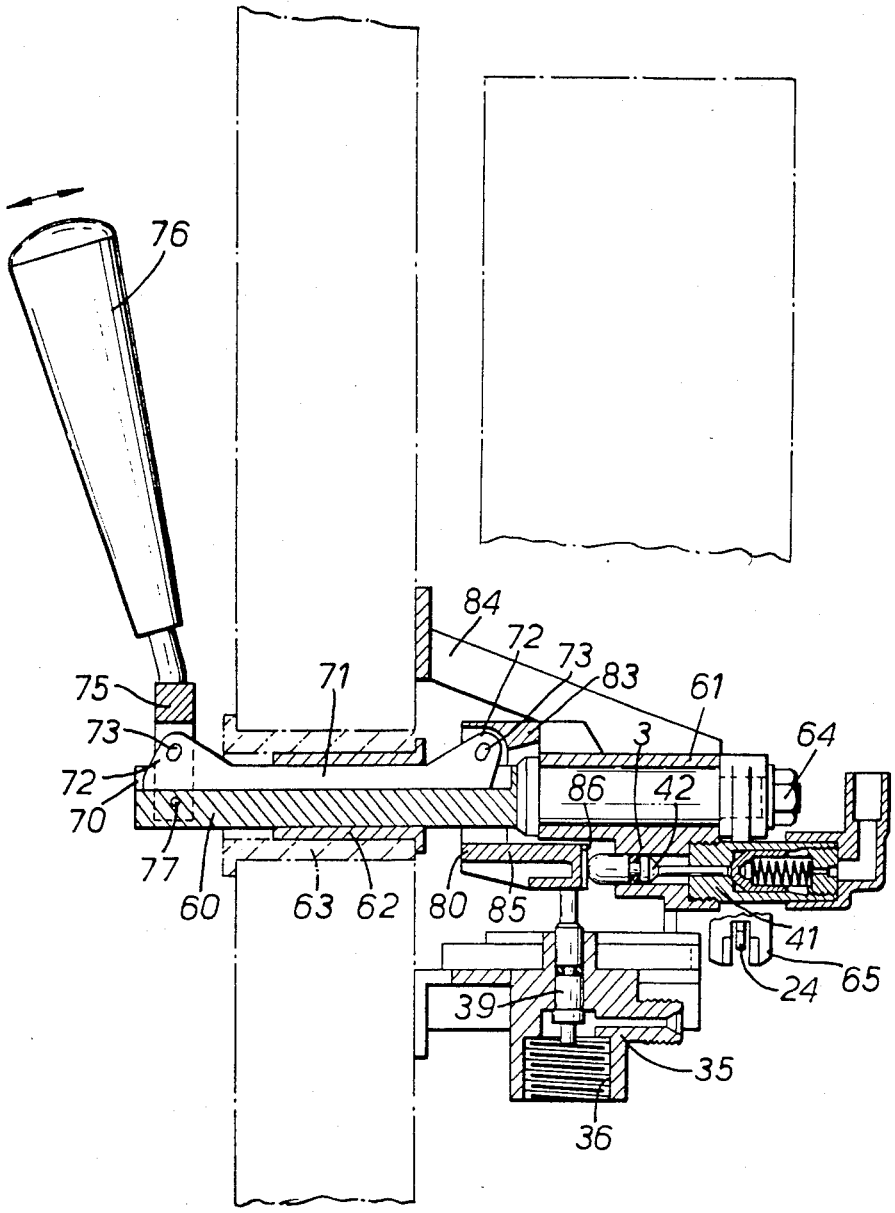
FIG. 3 is a vertical section illustrating the control arrangement.

The outer end portion of the control shaft 60 includes a longitudinal groove 70 in which a key 71 is received for sliding movement. Over the part of its length which passes through the door 1 the key 71 has a cross-section corresponding to that of the groove 70 so that it substantially fills the groove. This is an important feature since it precludes any free passages enabling air to flow through the door. The small sliding clearance between the key 71 and the shaft 60 can be sealed off by a thin layer of lubricating grease or oil. Both the shaft 60 and the key 71 are furthermore made of thermally insulating plastics material to avoid any heat conducting path through the refrigerator door, which would also have an adverse effect on the refrigerator efficiency. At each end the key 71 has a protruding ear 72 equipped with a hole 73 to receive a pivot point. A yoke 75 carrying an operating lever or handle 76 is connected to the outer end of shaft 60 by a first pivot 77 and is connected to the key 71 by a second parallel pivot passing through the hole 73. Thus the free end of lever 76 can be turned to rotate the shaft 60, as indicated by the arrow in FIG. 4, and pushed backwards and forwards to displace the key 71 longitudinally of the shaft 60, as indicated by the arrow in FIG. 3. A valve actuating collar 80 surrounds the shaft at an intermediate position and is connected to rotate with the shaft by a transverse pivot 81. The inner end of key 71 is connected to the collar by a pin passing through hole 73 whereby longitudinal displacement of the key 71 causes the collar 80 to turn about the pivot 81. The collar 80 has an integral rearwardly projecting tongue 83 and the sleeve portion 61 of the chassis section 3 carries a pair of upwardly and forwardly extending arms 84 connecting one of the mounting points 6. The arms define a gate 82 of width slightly greater than that of the tongue 83 so that, when the shaft is in the angular position illustrated with the spool valve 16 closed, the collar 80 can be tipped rearwardly about the pivot 81 and the tongue 83 will enter the gate 82 between the arms 84. In all other angular positions of the shaft 60 the tongue 83 abuts the arms 84 to prevent the collar 80 being tipped in this way. In its lower portion the collar includes an integral rearwardly extending segment 85, the end surface of which is provided with a central projection 86 and is arranged to act upon the end of the operating pin 42 of the relief valve 41, and the outer peripheral surface of which is arranged to act upon the operating pin 39 of the valve 38. In the position shown in the drawings, the projection 86 depresses pin 42 slightly against the bias of the relief valve spring, thereby holding the relief valve 41 open, and the pin 39 is not depressed so the valve 38 remains closed. When the collar 80 is rocked about its pivot 81 by rearward displacement of the key 71, the segment 85 is moved firstly to release the pin 42 so that the relief valve 41 closes, and then to depress the pin 39 to open the valve 38. From the foregoing description it will be understood that the valve 38 can only be opened when the spool valve 16 closes the liquid port 11 of the carbonating chamber due to the cooperating between the tongue 83 and the gate 82.

The operation of the carbonating mechanism will now be described on the assumption that the reservoir tank 7 has been filled with water and mounted on the inside of the refrigerator door with the necessary connections properly made. The water in the tank is exposed to the cold air in the refrigerator cabinet and becomes chilled, which will improve its carbonation. The coil spring 67 normally biases the control shaft 60 to a position in which the spool 16 opens communication between the tank and the carbonating chamber. In this position of the shaft of the projection 86 on the collar segment 85 is out of register with pin 42 so both valves 41 and 38 are closed. Water flows from tank 7 into the carbonating chamber, and the displaced air passes back to the tank via vent 26 and tube 45, until the ball 30 is lifted into engagement with its seat 32 and the pressure of the air trapped in the top of the chamber prevents further inflow of water from the tank. The control lever 76 is then turned to a vertical position rotating the shaft 60 firstly to close the port 11 of the carbonating chamber by means of the valve spool, and then to bring projection 86 against the pin 42 to open the relief valve 41. This has the advantage of freeing the relief valve before any pressurisation of the chamber if it has become stuck closed, e.g. due to a long period without use, which is an important safety feature. The lever 76 may now be pushed to displace the key 71 for rocking the collar 80 to open the gas valve 38, the relief valve 41 first being allowed to close and the tongue 83 entering the gate 82 between the arms 84 as described above. The carbon dioxide gas is supplied to the jet nozzle 29 through the connector 35, tube 34, inlet port 25 and tube 28 to be injected into the water contained in the carbonation chamber. The gas dissolves and any undissolved gas collects in the air space above the liquid level gradually increasing the pressure. The maximum pressure is limited by the relief valve 41 which opens automatically when the preset pressure is reached to allow gas to escape from the chamber through the port 27. The opening and closing actions of the valve 41 provide an audible signal indicating that sufficient gas has been introduced to carbonate the water. The operating lever 76 is released allowing the collar 80 to pivot back and the gas valve 38 to close, but it cannot be turned for discharging the carbonated water, without first being pulled back to disengage the collar tongue 83 from the gate 82, thereby pressing the pin 42 inwardly against the force of the relief valve spring and opening the valve 41 to release the pressure in the carbonating chamber. Now the lever can be turned to a dispense position, the shaft 60 being rotated to displace the valve spool 16 to uncover the port 11 allowing the carbonated water to flow from the chamber to the discharge nozzle 21 mounted at the front side of the refrigerator door 1. The carbonated water is dispensed under gravity, the float valve 30–32 opening automatically as the level in the chamber falls to permit air to enter the chamber and enable free outflow of the carbonated water. The control lever 76 is returned to the initial 'chamber fill' position by the coil spring 67 and the chamber is again filled to the correct level ready for the next carbonation cycle.

It is to be noted that the lever 76 can be turned directly from the 'chamber fill' position to the 'dispense' position without going through a gas injection mode during which the gas valve 38 is opened. In such a case there will be no carbonation and chilled still water will be dispensed, whereby selection between carbonated and still water is available.

Because the water stored in the reservoir tank and in the carbonation chamber is cooled by the refrigerator an improved degree of carbonation is possible.

An important feature of the float valve is that the cage 31 holding the ball captive allows the ball to fall to a sufficient level below its seat to avoid any risk of it being lifted against the seat 31 by gas currents if attempt is made to pressurise the chamber when it is not filled with water to the correct level, which is possible if the tank 7 is allowed to run dry. The rush of gas through the air vent operates the whistle 48 to produce an audible warning signal indicating insufficient water in the chamber.

With the exception of the reservoir tank all the component parts of the carbonating apparatus are carried by the chassis frame so that the apparatus can be pre-assembled and mounted in the refrigerator as a unit. The apparatus is of compact light weight design and construction, is reliable and safe in operation and is simple to operate having a single control member. These features of the carbonating mechanism make it especially suitable for mounting within a refrigerator.

I claim:

1. A domestic refrigerator having a cold food compartment defined within a walled cabinet including a door, and a carbonating apparatus mounted within the cold compartment and operable to deliver carbonated liquid to a discharge nozzle, said carbonating apparatus being mounted on the inner side of the refrigerator door and comprising a sealed pressure chamber and a reservoir tank both exposed to the temperature in the cold compartment, valve means to control supply of liquid to the pressure chamber from the reservoir tank and discharge of liquid from the pressure chamber to the nozzle, a gas supply valve for controlling supply of pressurized gas from a gas source to the pressure chamber, an exhaust valve operable to release the gas pressure in the pressure chamber, and a control arrangement for extending through the refrigerator door and coupled to the liquid flow control valve means, said gas supply valve and said exhaust valve for operating the carbonating apparatus manually from outside the refrigerator, the liquid flow control valve means comprising a valve member movable in opposite directions to connect the pressure chamber to the reservoir tank and the discharge nozzle, respectively, the valve member being coupled to the control arrangement to be driven thereby in both said opposite directions, and said discharge nozzle being mounted to deliver liquid on the outer side of the door.

2. A refrigerator according to claim 1, wherein the pressure chamber includes a bottom wall defined by a base member and having a port therein, the liquid control valve means comprising a housing provided by the base member, and the valve member being movable in the housing to either side of a central closed position for connecting the port to the tank and to the discharge nozzle, respectively.

3. A refrigerator according to claim 2, wherein the valve member comprises a spool slidable in a horizontal bore in the base member.

4. A refrigerator according to claim 1, 2 or 3 wherein the control arrangement includes a common valve actuating member for operating the gas supply valve and for actuating the exhaust valve, and a control shaft for operating the liquid control valve means, said actuating member being so arranged and coupled to the control shaft that the gas supply valve can be opened thereby for admitting pressurised gas to the pressure chamber only if the liquid control valve is closed, and the liquid control valve can be opened to discharge liquid from the pressure chamber only after the pressure has been released by opening the exhaust valve.

5. A refrigerator according to claim 4, wherein the control shaft is journalled with the axis thereof transverse to the direction of movement of the valve member, the shaft being coupled to the valve member for displacing the valve member in response to rotary motion of the shaft, and the valve actuating member being movably mounted on the shaft.

6. A refrigerator according to claim 4 or 5, wherein the valve actuating member is pivoted to the control shaft (60) to rock about an axis transverse to the shaft axis.

7. A refrigerator according to claim 6, wherein the shaft is journalled in a stationary support supporting the exhaust valve and the gas supply valve, and the stationary support co-operates with the valve actuating member to prevent said member pivoting to open the gas valve unless the shaft is positioned to close the liquid control valve, and to ensure that said member must be pivoted to open the exhaust valve before the shaft can be turned to open the liquid control valve to discharge liquid from the chamber.

8. A refrigerator according to claim 1 or 2, wherein the control shaft extends through the refrigerator door to the outside thereof, and the control shaft is made of thermally insulating material.

9. A refrigerator according to claim 8, wherein the control shaft includes a link member slidable longitudinally thereof and coupled to the valve actuating member for operating said member.

10. A refrigerator according to claim 9, wherein the link member is a key slidable in a longitudinal groove (70) in shaft, the key being connected by respective pivots to the valve actuating member and to a control lever mounted at the outer end of the shaft.

11. A refrigerator according to claim 10, wherein the carbonating apparatus includes a support structure supporting the pressure chamber and defining a bottom wall of the pressure chamber, the liquid control valve means, the exhaust valve and the gas supply valve being firmly supported by the support structure, and the control arrangement being carried by the support structure at a position laterally of the pressure chamber.

12. A refrigerator according to claim 11 wherein the support structure is assembled from a plurality of moulded sections which are interlocked with snap-fit connections to form a substantially rigid structure.

13. A refrigerator according to claim 1, wherein the pressure chamber includes an exhaust outlet leading from an upper part of the chamber to atmosphere via a relief valve operable to limit the pressure in the chamber, said relief valve constituting the exhaust valve actuable to release the pressure in the chamber, and a vent connecting an upper part of the chamber to atmosphere, and a float valve located in the chamber for closing the vent to limit the level of liquid in the chamber and trap a volume of gas in the chamber.

14. A refrigerator according to claim 13, wherein the vent and the exhaust outlet are connected to the atmosphere above the liquid in the tank to preclude any leakage of liquid.

15. A refrigerator according to claim 13 wherein the vent is connected to a warning device adapted to produce an audible warning signal if attempt is made to pressurise the chamber with insufficient liquid therein to close the float valve.

16. A refrigerator according to claim 15 wherein the top of the chamber is closed by a cover including the exhaust outlet and supporting a gas inlet nozzle and said float valve.

17. A refrigerator according to claim 16, wherein the float valve comprises a downwardly facing seat and a float member for sealing against the seat and hedl within a cage, the cage being of sufficient length that the float member will not be lifted into engagement with the valve seat if an attempt is made to pressurize the chamber when it is empty of liquid.

18. A refrigerator according to claim 1, wherein the liquid control valve means can be operated by the control arrangement to move from a position communicating the pressure chamber with the tank to a position communicating the pressure chamber with the discharge nozzle without any supply of gas to the chamber, whereby the apparatus may be operated selectively to dispense either chilled still liquid or carbonated liquid.

19. A refrigerator according to claim 3, wherein the control arrangement includes a common valve actuating member for operating the gas supply valve and for actuating the exhaust valve, and a control shaft for operating the liquid control valve means, said actuating member being so arranged and coupled to the control shaft that the gas supply valve can be opened thereby for admitting pressurized gas to the pressure chamber only if the liquid control valve is closed, and the liquid control valve can be opened to discharge liquid from the pressure chamber only after the pressure has been released by opening the exhaust valve.

20. A refrigerator according to claim 19, wherein the control shaft is journalled with the axis thereof transverse to the direction of movement of the valve spool, the shaft being coupled to the valve spool for displacing the valve spool in response to the rotary motion of the shaft, and the valve actuating member being movably mounted on the shaft.

* * * * *